US007762869B2

(12) United States Patent
Yoon

(10) Patent No.: US 7,762,869 B2
(45) Date of Patent: Jul. 27, 2010

(54) NOZZLE FOR SPRAYING SUBLIMABLE SOLID PARTICLES ENTRAINED IN GAS FOR CLEANING SURFACE

(75) Inventor: Cheol-Nam Yoon, Anseong-si (KR)

(73) Assignee: K.C. Tech Co., Ltd., Gyeonggi-Do (KR)

( * ) Notice: Subject to any disclaimer, the term of this patent is extended or adjusted under 35 U.S.C. 154(b) by 209 days.

(21) Appl. No.: 12/061,833

(22) Filed: Apr. 3, 2008

(65) Prior Publication Data

US 2009/0039178 A1 Feb. 12, 2009

Related U.S. Application Data

(62) Division of application No. 11/136,732, filed on May 25, 2005, now Pat. No. 7,442,112.

(30) Foreign Application Priority Data

May 31, 2004 (KR) ..... 2004-0039305
Dec. 28, 2004 (KR) ..... 2004-0114260

(51) Int. Cl.
*B24B 49/00* (2006.01)
*B24B 51/00* (2006.01)
*B24C 5/04* (2006.01)

(52) U.S. Cl. ..... 451/8; 451/53; 451/102

(58) Field of Classification Search ..... 134/7, 134/93, 94.1, 95.1; 261/75, 158–161; 451/8, 451/36, 38, 39, 40, 53, 102
See application file for complete search history.

(56) References Cited

U.S. PATENT DOCUMENTS

| | | | |
|---|---|---|---|
| 4,389,820 | A | 6/1983 | Fong et al. |
| 4,631,250 | A | 12/1986 | Hayashi |
| 4,806,171 | A | 2/1989 | Whitlock et al. |
| 4,972,677 | A | 11/1990 | Moriya et al. |
| 5,018,667 | A | 5/1991 | Lloyd |
| 5,054,249 | A | 10/1991 | Rankin |
| 5,125,979 | A | 6/1992 | Swain et al. |

(Continued)

FOREIGN PATENT DOCUMENTS

EP 0 332 356 5/1993

(Continued)

*Primary Examiner*—Timothy V Eley
(74) *Attorney, Agent, or Firm*—Leydig, Voit & Mayer, Ltd.

(57) ABSTRACT

A nozzle for spraying sublimable solid particles and preventing frost from forming at surfaces of the nozzle. The nozzle includes: a cleaning agent block for phase-changing a cleaning agent into a snow containing sublimable solid particles; a nozzle block for growing the cleaning agent snow through adiabatic expansion and spraying the grown cleaning agent snow onto a surface of an object; a carrier gas block for supplying a carrier gas to the nozzle block to mix with the cleaning agent snow; and a heater for heating at least a portion of the carrier gas supplied from the carrier gas supply source. Fine dry ice particles and liquid $CO_2$, passing through a solenoid valve from a $CO_2$ reservoir tank and a pressure drop of a flow rate regulation valve, are introduced into the spray nozzle and then mixed with the carrier gas, such as N2 or purified air, and discharged.

9 Claims, 8 Drawing Sheets

U.S. PATENT DOCUMENTS

| | | | |
|---|---|---|---|
| 5,209,028 | A | 5/1993 | McDermott et al. |
| 5,294,261 | A | 3/1994 | McDermott et al. |
| 5,315,793 | A | 5/1994 | Peterson et al. |
| 5,364,474 | A | 11/1994 | Williford, Jr. |
| 5,377,911 | A | 1/1995 | Bauer et al. |
| 5,390,450 | A | 2/1995 | Goenka |
| 5,409,418 | A | 4/1995 | Krone-Schmidt et al. |
| 5,445,553 | A | 8/1995 | Cryer et al. |
| 5,456,629 | A | 10/1995 | Bingham |
| 5,512,106 | A | 4/1996 | Tamai et al. |
| 5,616,067 | A | 4/1997 | Goenka |
| 5,822,818 | A | 10/1998 | Chao et al. |
| 5,846,338 | A | 12/1998 | Bonora et al. |
| 5,976,267 | A | 11/1999 | Culkins et al. |
| 6,168,503 | B1 | 1/2001 | Pao et al. |
| 6,390,899 | B1 | 5/2002 | Loubeyre |
| 6,695,686 | B1 | 2/2004 | Frohlich et al. |
| 6,773,581 | B2 | 8/2004 | Hazlebeck et al. |
| 7,442,112 | B2 * | 10/2008 | Yoon ..... 451/8 |

FOREIGN PATENT DOCUMENTS

| | | |
|---|---|---|
| EP | 0 633 098 | 1/1999 |
| JP | 6-295895 | 10/1994 |
| KR | 2000-052044 | 8/2000 |
| WO | WO 02/075799 | 9/2002 |

* cited by examiner

NOZZLE FOR SPRAYING SUBLIMABLE SOLID PARTICLES ENTRAINED IN GAS FOR CLEANING SURFACE

BACKGROUND OF THE INVENTION

1. Field of the Invention

The present invention relates to a nozzle for spraying sublimable solid particles entrained in gas, such as $CO_2$ snow or Ar snow, onto a surface of an object to be cleaned, and more particularly, to a nozzle for spraying sublimable solid particles capable of preventing frost from forming at surfaces of the nozzle and the object due to ultra-low temperature snow.

2. Description of the Related Art

As is well known, fine contaminant particles can be removed from a surface of an object to be cleaned, such as a semiconductor wafer or an LCD (liquid crystal display) substrate, using $CO_2$ mixed with solid particles and gases—so-called $CO_2$ snow—without damaging the surface of the object.

The $CO_2$ snow passes through a venturi formed in a nozzle to generate solid particles which then grow and are sprayed onto the surface of the object to remove fine contaminant particles using impact energy of the solid particles colliding with the object. The impact energy of the $CO_2$ snow may be increased by accelerating the $CO_2$ snow using inert gas such as N2 (generally, referred to as carrier gas). $CO_2$ snow that has removed contaminants by colliding with the surface of the object can be directly sublimated so as to leave no residue on the surface of the object. This cleaning method may be performed using sublimable solid particles such as Ar, and so on, for the substitution of $CO_2$.

However, since the cleaning method using the $CO_2$ snow is performed at a very low temperature of not more than −60° C., moisture in the air may condense on the surfaces of the nozzle and the object to generate frost. When frost is generated, contaminants in the air may attach to a surface of the substrate to seriously damage the semiconductor wafer or the LCD substrate, which requires a very fine cleaning process.

Therefore, typically, it is possible to prevent frost by receiving the nozzle and the object in a sealed chamber and maintaining the chamber at high temperature and low humidity. In this case, since static electricity may be generated in a dry environment and cause contaminant particles separated from the surface of the object to be reattached to the surface of the object, a separate device for preventing static electricity is required, which places a restriction on the cleaning environment and requires a plurality of auxiliary members.

SUMMARY OF THE INVENTION

The present invention provides a nozzle for spraying sublimable solid particles entrained in gas for cleaning a surface, and a method of cleaning a surface using the nozzle, capable of preventing frost from forming at surfaces of the nozzle and an object to be cleaned, without need of separate environmental control.

According to an aspect of the present invention, there is provided a nozzle for spraying sublimable solid particles entrained in gas for cleaning a surface, the nozzle including: a cleaning agent block for phase-changing a cleaning agent introduced from a cleaning agent supply source into a snow state containing sublimable solid particles; a nozzle block for growing the cleaning agent snow introduced from the cleaning agent block through adiabatic expansion and spraying the grown cleaning agent snow onto a surface of an object; a carrier gas block for supplying a carrier gas introduced from a carrier gas supply source to the nozzle block to mix with the cleaning agent snow; and a heater for heating at least a portion of the carrier gas supplied from the carrier gas supply source.

The spray nozzle may further include a flow rate regulation valve installed at an inlet port of the cleaning agent block to control a flow rate of the cleaning agent supplied to an outlet port of the cleaning agent block.

The nozzle block may further include a venturi for growing the cleaning agent snow introduced from the cleaning agent block through adiabatic expansion; and an anti-frost passage, formed to surround the venturi, for introducing at least a potion of the carrier gas introduced from the carrier gas block. The carrier gas may be supplied from the carrier gas block to the venturi and the anti-frost passage of the nozzle block in a ratio of 9:1-7:3.

The heater may be installed at a side of at least one of the carrier gas supply source, the carrier gas block, and a carrier gas supply passage from the carrier gas supply source to the carrier gas block, or may otherwise be installed at the anti-frost passage of the nozzle block.

According to another aspect of the present invention, when the present invention employs a multi-nozzle, a spray nozzle includes: a cleaning agent block having an inlet port in fluid communication with a cleaning agent supply source, and an outlet port made of a plurality of orifices disposed in parallel to phase change a cleaning agent into a snow state containing sublimable solid particles; a nozzle block having a plurality of inlet ports introducing a cleaning agent snow formed by the orifices of the cleaning agent block, a plurality of venturies for growing the cleaning agent snow introduced to the respective inlet ports through adiabatic expansion, and a plurality of outlet ports in fluid communication with the respective venturies to spray the cleaning agent snow grown through the venturies onto a surface of an object; a carrier gas block having an inlet port in fluid communication with a carrier gas supply source, and an outlet port in fluid communication with the plurality of inlet ports of the nozzle block to mix a carrier gas with the cleaning agent snow; and a heater for heating the carrier gas supplied from the carrier gas supply source.

The multi-nozzle of the present invention may also further include a flow rate regulation valve installed at the inlet port of the cleaning agent block to control a flow rate of the cleaning agent supplied to the outlet port of the cleaning agent block.

Each of the venturies of the nozzle block may be made of first and second venturies disposed in series to grow the cleaning agent snow two times. An intermediate passage having a certain inner diameter may be installed between the first and second venturies to facilitate the mixing of the cleaning agent snow and the carrier gas.

In disposing the carrier gas block and the cleaning agent block, the carrier gas block may be installed at the inlet port of the nozzle block, the cleaning agent block may be installed on the nozzle block, and the inlet port of the nozzle block in fluid communication with the orifice of the cleaning agent block may be in fluid communication with a throttle rear end of the venturi. Alternatively, the carrier gas block may be formed to surround the cleaning agent block to be engaged with a front end of the nozzle block.

The nozzle block may be formed to surround the venturi, and may further include an anti-frost passage in fluid communication with the outlet port of the carrier gas block. In this connection, the carrier gas may be supplied from the carrier gas block to the venturi of the nozzle block and the anti-frost passage, in a ratio of 9:1-7:3.

The heater may be installed at the anti-frost passage of the nozzle block; otherwise, installed at a side of at least one of the carrier gas supply source, the carrier gas block, and a carrier gas supply passage from the carrier gas supply source to the carrier gas block.

A thermocouple sensor may be additionally installed at an outlet end of the cleaning agent block or the nozzle block to determine whether $CO_2$ is supplied by detecting temperature variation when $CO_2$ is sprayed.

The nozzle may further include a solenoid valve installed at the inlet port thereof to control the supply of $CO_2$ through open/close operations in response to electrical signals.

In every case as described, the cleaning agent may be one of $CO_2$ or Ar, and the carrier gas may be one of $N_2$ and air.

According to still another aspect of the present invention, there is provided a method of cleaning a surface using sublimable solid particles, including: phase-changing a cleaning agent into a snow state containing sublimable solid particles; heating at least a portion of carrier gas before mixing the cleaning agent with the carrier gas; adiabatically expanding the phase changed cleaning agent snow by mixing with the carrier gas; and spraying the mixture of the adiabatically expanded cleaning agent and the carrier gas onto a surface of an object.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
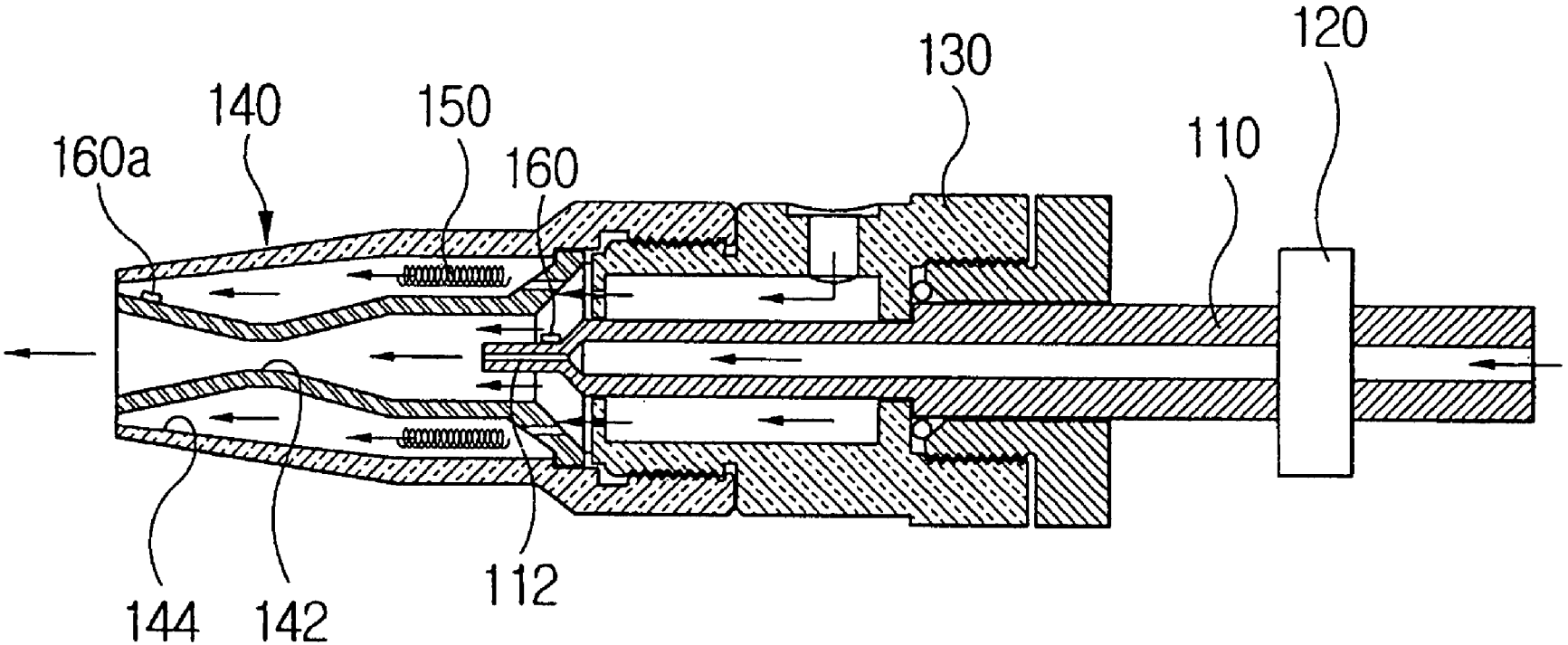
FIG. 1 is a cross-sectional view illustrating a spray nozzle according to an embodiment of the present invention employing a single nozzle.

The present invention will now be described more fully with reference to the accompanying drawings, in which exemplary embodiments of the invention are shown. This invention may, however, be embodied in different forms and should not be construed as limited to the embodiments set forth herein. Rather, these embodiments are provided so that this disclosure is thorough and complete and fully conveys the scope of the invention to those skilled in the art. In the drawings, the thickness of layers and regions may be exaggerated for clarity. Like elements are denoted by like reference numerals throughout the specification and drawings.

Embodiment 1

Single Nozzle

FIG. 1 illustrates a nozzle for spraying sublimable solid particles entrained in gas for cleaning a surface in accordance with a first embodiment of the present invention. The nozzle of FIG. 1 is a single nozzle having one outlet port for sublimable solid particles.

As shown in FIG. 1, the single nozzle in accordance with the present invention includes a cleaning agent block 110, a flow rate regulation valve 120, a carrier gas block 130, a nozzle block 140, and a heater 150. In this process, a cleaning agent is generally referred to as a sublimable material such as $CO_2$, Ar, and so on, available for cleaning a surface of an object using the nozzle of the present invention.

The cleaning agent block 110 is a cylindrical pipe member that has an inlet port formed at a rear end and is in fluid communication with a cleaning agent supply source (not shown) such as a $CO_2$ tank through a pipeline. An outlet port formed at a front end of the cleaning agent block 110 is made of an orifice 112 having a small diameter. Preferably, the orifice 112 is formed long like a needle projecting toward the front of the cleaning agent block 110. In addition, the flow rate regulation valve 120 is installed adjacent to the inlet port of the cleaning agent block 110 to control a supply flow rate of the cleaning agent supplied to the outlet port. Alternatively, the flow rate regulation valve 120 may be installed on the pipeline connected to the inlet port of the cleaning agent block 110.

The carrier gas block 130 surrounds the periphery of the cleaning agent block 110, and has an inlet port connected to a carrier gas supply source (not shown) through a pipeline. An outlet port of the carrier gas block 130 is in fluid communication with an inlet port of the nozzle block 140 together with the outlet port of the cleaning agent block 110, as will be described below. Preferably, an outlet port of the carrier gas block 130 is located at the outlet port of the cleaning agent block 110, i.e., slightly to the rear of the orifice 112. Inert gas such as nitrogen ($N_2$) or purified air may be used as a carrier gas.

The nozzle block 140 is engaged with front sides of the cleaning agent block 110 and the carrier gas block 130 to allow the inlet port of the nozzle block 140 to be in fluid communication with the outlet port of the cleaning agent block 110 together with the outlet port of the carrier gas block 130. Therefore, the cleaning agent supplied through the cleaning agent block 110 is mixed with the carrier gas supplied through the carrier gas block 130 at the inlet port of the nozzle block 140. The outlet port of the nozzle block 140 is directed to the surface of the object, and has a venturi 142 for growing particles of the cleaning agent, i.e., $CO_2$ snow, between the inlet port and the outlet port.

In addition, the nozzle block 140 has an anti-frost passage 144 formed surrounding the venturi 142. The anti-prost passage 144 has a separate inlet port in fluid communication with the outlet port of the carrier gas block 130 to allow a portion of the carrier gas supplied from the carrier gas block 130 to the nozzle block 140 to be introduced into the anti-frost passage 144, and a separate outlet port formed to surround the outlet port of the nozzle block 140. The carrier gas is supplied from the carrier gas block 130 to the venturi 142 through the inlet port of the nozzle block 140 and to the anti-frost passage 144, in a ratio of 9:1-7:3, and preferably 8:2.

The heater 150, a coil-shaped thermoelectric wire, is installed at the anti-frost passage 144, and preferably at the inlet port of the anti-frost passage 144. Thereby, the carrier gas flowing through the anti-frost passage 144 is heated by the heater 150 and sprayed at a temperature of about 100-200° C.

Alternatively, the heater 150 may be installed at any one side of the carrier gas supply source, the carrier gas block 130, and a carrier gas supply passage from the carrier gas supply source to the carrier gas block 130. In this case, the high-temperature carrier gas is supplied to the venturi 142 as well as to the anti-frost passage 144. As described above, even when the high-temperature carrier gas is supplied into the venturi 144 of the nozzle block 140, very high-speed $CO_2$ snow particles arrive at the surface of the object before they are melted by the high-temperature carrier gas, thereby obtaining a sufficient cleaning effect. In this case, the nozzle may have a more simple structure since the anti-frost passage 144 is unnecessary. However, since it is advantageous to overall cleaning performance that the high-temperature carrier gas is not mixed with the $CO_2$ snow, in consideration of particle growth in the venturi 144, the embodiment of FIG. 1 may be preferable.

A process of cleaning a surface of an object using the single nozzle in accordance with the present invention is performed as follows.

The cleaning agent, $CO_2$, is supplied from the cleaning agent supply source to the cleaning agent block 110. It is possible to minimize consumption of the cleaning agent by controlling flow rate of the cleaning agent through the flow rate regulation valve 120 installed at the cleaning agent block 110, without decreasing cleaning performance. The cleaning agent is changed into a snow state in which gas and solid particles are mixed together, through adiabatic expansion when the cleaning agent is discharged to the inlet port of the nozzle block through the outlet orifice 112 of the cleaning agent block 110.

The carrier gas is supplied from the carrier gas supply source to the nozzle block 140 through the carrier gas block 130, and mixed with $CO_2$ snow at the inlet port of the nozzle block 140. The $CO_2$ snow is accelerated by mixing with the carrier gas, and expanded through the venturi 142, thereby growing solid particles in the $CO_2$ snow. The $CO_2$ snow passing through the venturi 142 is sprayed onto the surface of the object through the outlet port of the nozzle block 140, and kinetic energy of the $CO_2$ snow is transferred through impact to remove contaminants from the surface of the object.

At the same time, a portion of the carrier gas supplied from the carrier gas block 130 flows through the anti-frost passage 144 of the nozzle block 140 and is heated up to about 100-200° C. by the heater 150 installed at the anti-frost passage 144. A high-temperature carrier gas flows between surfaces of the venturi 142 and the nozzle block 140, through which the $CO_2$ snow passes, to prevent frost from forming at the surface of the nozzle. In addition, when the nozzle moves along the surface of the object, the high-temperature carrier gas sprayed around the $CO_2$ snow onto the surface of the object heats and dries the surface of the object before/after cleaning by the $CO_2$ snow, thereby preventing frost from forming at the surface of the object.

Meanwhile, the nozzle of the present invention may employ a thermocouple sensor 160 or 160*a* to determine whether $CO_2$ supplied from the cleaning agent supply source is sprayed. The thermocouple sensor 160 or 160*a* may be installed at a side end of the cleaning agent block 110 or one side of the nozzle block 140 in order to prevent the sensor from being frozen by $CO_2$ having a temperature of about −70° C. For example, referring to FIG. 1, when the sensor 160 is installed at the side of the cleaning agent block 110, the sensor 160 is preferably fixed to an end of the outlet port of the cleaning agent block 110, i.e., an exterior surface of the orifice 112, connected to an inner side of the venturi 142. In addition, when the sensor 160*a* is installed at the one side of the nozzle block 140, the sensor 160*a* is preferably fixed to the interior of the anti-frost passage 144, i.e., the exterior surface of the venturi 142. While not shown, the thermocouple sensor 160 or 160*a* may be fixed using a predetermined fastening means such as a pin, a belt, and so on.

As described above, the thermocouple sensor 160 or 160*a* installed at the end of the cleaning agent block 110 or the nozzle block 140, i.e., the surface of the orifice 112 or the venturi 142, detects temperature variation within a temperature range of −50-0° C. during supply of $CO_2$ through the cleaning agent block 110 and $N_2$ through the carrier gas block 130.

When no $CO_2$ is supplied, the nozzle of the present invention maintains a temperature of no less than 0° C., which is detected by the thermocouple sensor 160 or 160*a*. But when $CO_2$ is supplied, the temperature around the cleaning agent block 110 is rapidly lowered to decrease the temperature detected by the thermocouple sensor 160 or 160*a* to no more than 0° C. Therefore, the nozzle of the present invention is capable of determining whether $CO_2$ is sprayed by the temperature detected by the thermocouple sensor.

Figure 2A:
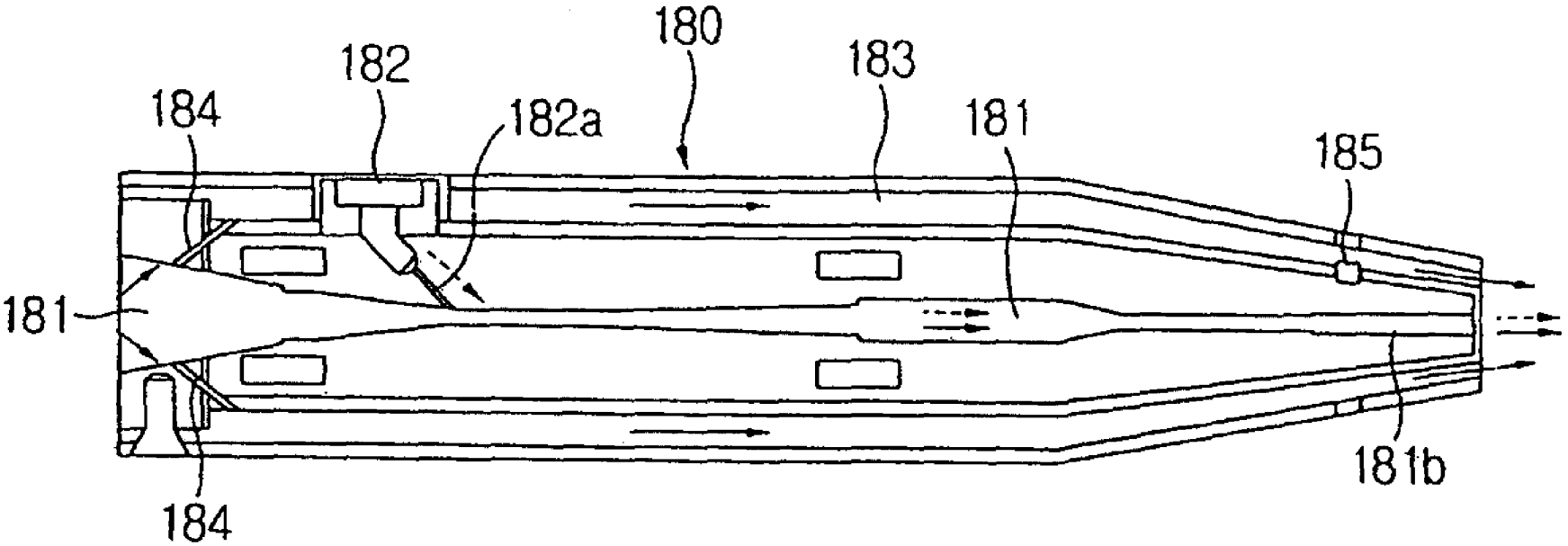
FIG. 2A is a longitudinal cross-sectional view illustrating a modified example of the single nozzle of FIG. 1.
Figure 2B:
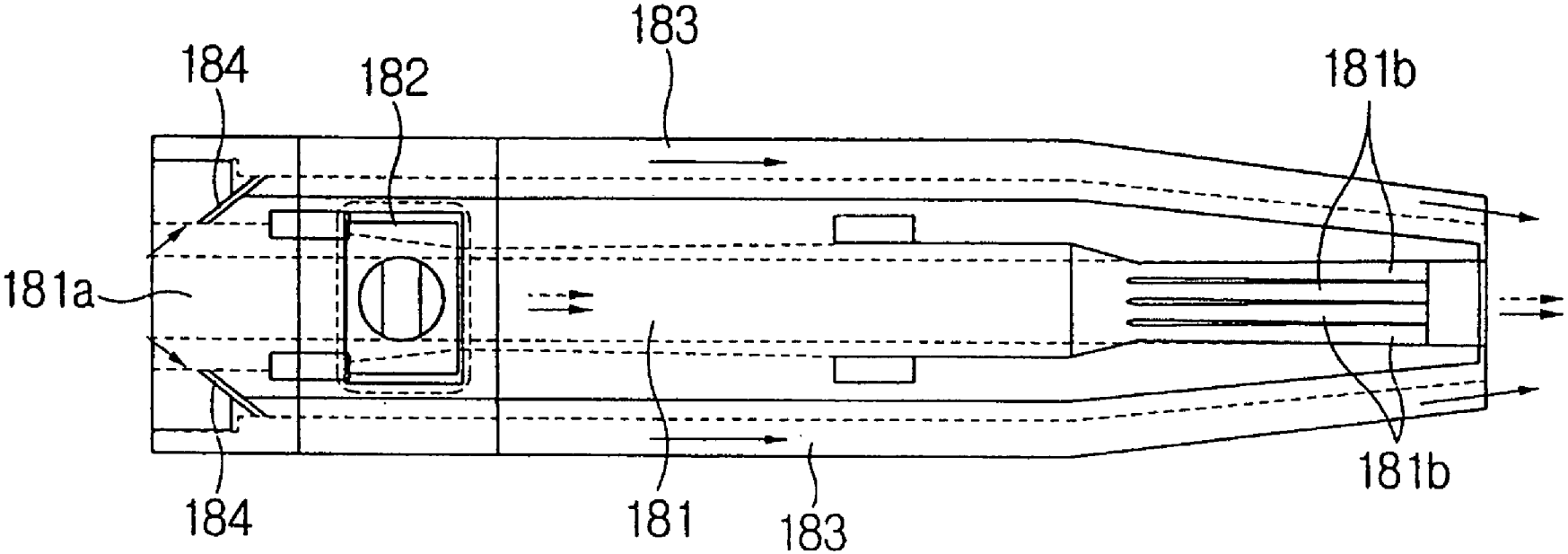
FIG. 2B is a lateral cross-sectional view of the single nozzle of FIG. 2A.

The nozzle of the present invention may be provided as a structure shown in FIGS. 2A and 2B by modifying the structure of FIG. 1. FIG. 2A is a longitudinal cross-sectional view of a single nozzle, and FIG. 2B is a lateral cross-sectional view of the single nozzle. Preferably, the single nozzle is made of a single nozzle block 180 that is not divided into a plurality of blocks, unlike the nozzle of FIG. 1. The nozzle block 180 has a first passage 181 for spraying a cleaning agent such as $CO_2$ or Ar, formed from an inlet port to an end of an outlet port of the nozzle block 180, and the first passage 181 may be formed to have a venturi shape from the inlet port to the outlet port in order to grow $CO_2$ snow, similar to the venturi 142 of FIG. 1. In this case, the first passage 181 may include at least one venturi. In addition, as shown in FIG. 2B, the first passage 181 may include an inlet port 181*b* having a single wide passage and an outlet port 181*b* having a plurality of narrow passages.

In this modified embodiment, the inlet port of the nozzle block 180 is in fluid communication with the carrier gas supply source (not shown) so that carrier gas →, such as $N_2$ or CDA (clean dry air), is introduced therethrough. In addition, a cleaning agent inlet port 182 in fluid communication with the cleaning agent supply source (not shown) is formed at a surface spaced apart from an end of the inlet port of the nozzle block 180, and the cleaning agent $CO_2$ ⇢ is supplied through the cleaning agent inlet port 182. The cleaning agent inlet port 182 extends into the interior of the nozzle block 180 to be in fluid communication with the first passage 181, and $CO_2$ is introduced into the first passage 181. A second passage 183 for spraying the carrier gas → is formed between the exterior of the first passage 181 and an inner periphery of the nozzle block 180.

In addition, a guide 184 for guiding carrier gas is installed at the inlet port of the nozzle block 180. The guide 184 is directed to the inner periphery of the nozzle block 180 to be in fluid communication with the second passage 183, most $N_2$ or CDA → supplied from the carrier gas supply source is introduced into the second passage 183 by the guide 184 to flow toward the outlet port of the nozzle block 180.

As shown in FIGS. 2A and 2B, the guide 184 has a punched hole shape of a predetermined size to be in fluid communication with the first passage 181, through which a portion of the carrier gas → such as N2 or CDA is introduced to be mixed with $CO_2$ ⇢ flowing in from the cleaning agent inlet port 182 and then discharged to the exterior through the outlet port of the nozzle block 180.

A reference numeral 182*a* of FIG. 2A is an orifice functioning to phase change the cleaning agent $CO_2$ into a snow state containing solid particles, and may include a plurality of orifices arranged parallel to each other.

Meanwhile, a separate thermocouple sensor 185 may be additionally installed at an end of the outlet port of the nozzle block to determine whether $CO_2$ supplied from the cleaning agent supply source is sprayed, similar to FIG. 1. In addition, while not shown, the second passage may further include a separate heater functioning as the anti-frost passage 144 of FIG. 1.

Embodiment 2

Multi Nozzle 1

Figure 3:
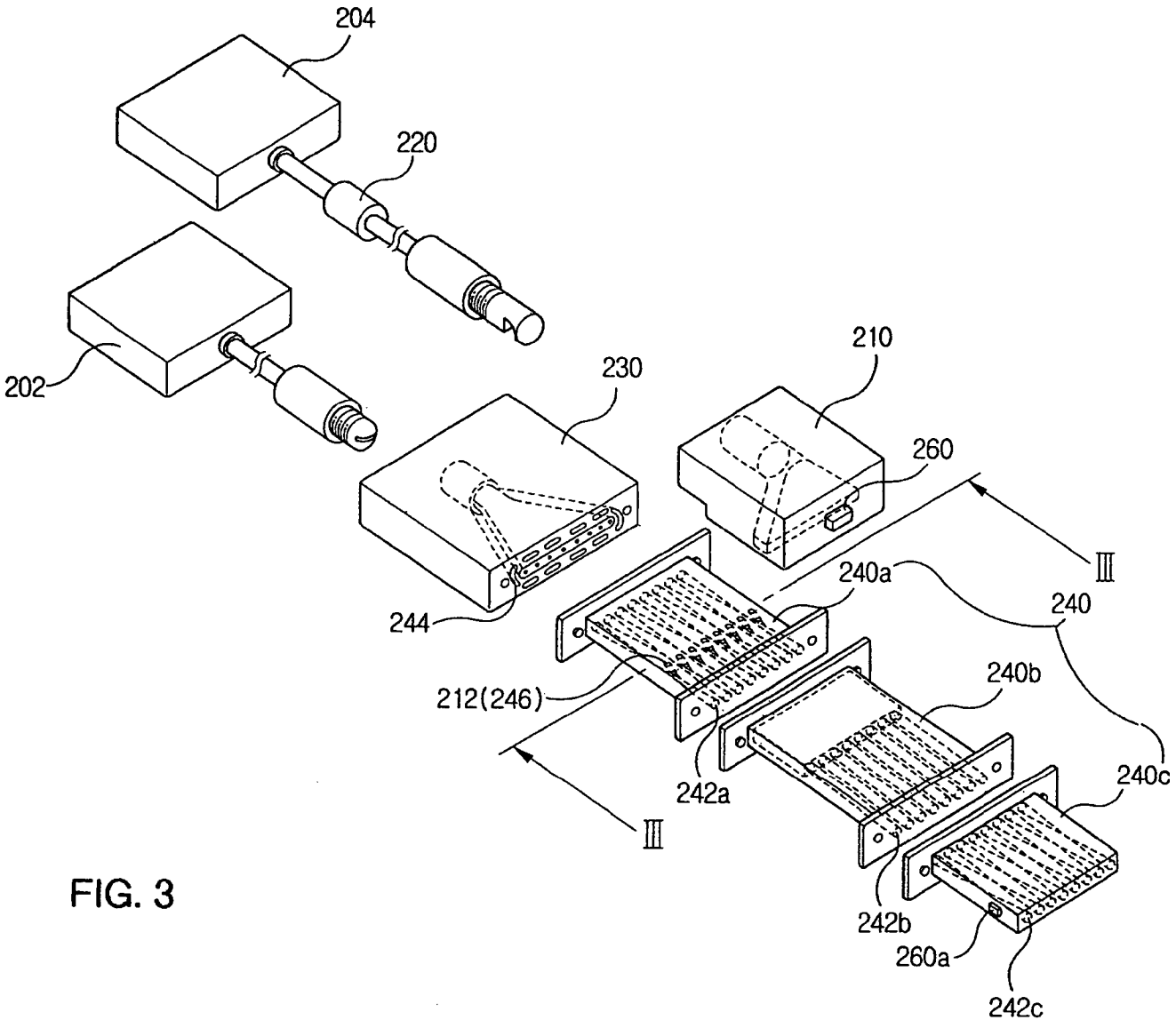
FIG. 3 is a perspective view illustrating a spray nozzle according to another embodiment of the present invention employing a multi nozzle.
Figure 4:
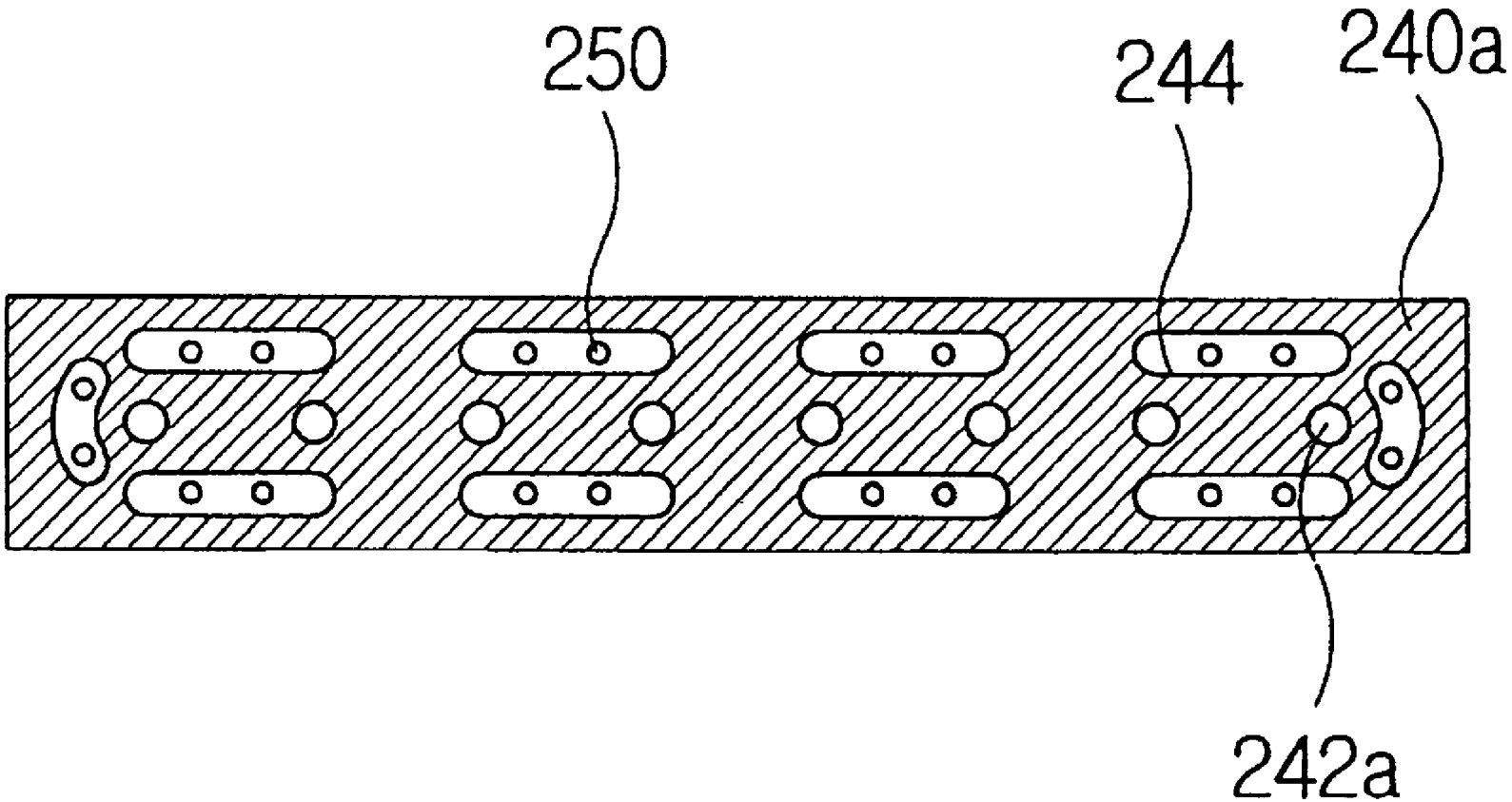
FIG. 4 is a cross-sectional view taken along line III-III of FIG. 3.

FIG. 3 is a perspective view of a spray nozzle according to a second embodiment of the present invention employing a multi nozzle, and FIG. 4 is a cross-sectional view taken along line III-III of FIG. 3. The embodiment of FIGS. 3 and 4 adds the technical spirit of the present invention to a multi nozzle described in WO02/075799 A1, entitled "NOZZLE FOR INJECTING SUBLIMABLE SOLID PARTICLES ENTRAINED IN GAS FOR CLEANING SURFACE", filed by the present applicant, the disclosure of which is incorporated herein in its entirety by reference.

As shown in FIGS. 3 and 4, the multi nozzle in accordance with the present invention includes a cleaning agent block 210, a carrier gas block 230, a nozzle block 240, and a heater 250. The nozzle block 240 may include a first venturi block 240*a*, and a second venturi block 240*c*, and may further include an intermediate block 240*b* interposed between the first and second venturi blocks 240*a* and 240*c* (the present embodiment includes the intermediate block 240*b*). The first venturi block 240*a*, the intermediate block 240*b*, and the second venturi block 240*c* are sequentially disposed from the outlet port of the carrier gas block 230. The cleaning agent block 210 is formed on the first venturi block 240*a*.

The carrier gas block 230 has an inlet port in fluid communication with a carrier gas supply source 202, and extends to form a fan shape from the inlet port to an outlet port.

The first and second venturi blocks 240*a* and 240*c* of the nozzle block 240 have a plurality of venturies 242*a* and 242*c* disposed in parallel to a lateral direction. The intermediate block 240*b* has a plurality of passages 242*b* having a certain diameter to connect the venturies 242*a* and 242*c* of the first and second venturi blocks 240*a* and 240*c*. If necessary, as shown in FIGS. 3 and 4, inlet ports of the passages 242*b* of the intermediate block 240*b* may be formed to have a single common space.

In addition, an anti-frost passage 244 is formed to extend around the venturies 242*a* and 242*c* and the passages 242*b* of the nozzle block 240 (see FIG. 4). An inlet port of the anti-frost passage 244 is in fluid communication with the outlet port of the carrier gas block 230, and carrier gas is supplied to the venturi 242*a* and the anti-frost passage 244 in a ratio of 9:1-7:3, and preferably 8:2. In consideration of manufacturing problems, it is preferable that a plurality of anti-frost passages 244 are arranged along the periphery of the nozzle block 240.

The cleaning agent block 210 has an inlet port in fluid communication with a cleaning agent supply source 204, and a flow rate regulation valve 220 is installed on a pipeline adjacent to the inlet port. An outlet port of the cleaning agent block 210 is bent at a right angle to the inlet port, extends to form a fan shape similar to the carrier gas block 230, and has a plurality of orifices 212 in fluid communication with a lower end throttle of the respective venturies 242*a* of the first venturi block 240*a*. In consideration of manufacturing problems, a cleaning agent inlet port 246 may be formed at an upper surface of the first venturi block 240 to function as the orifices 212.

The heater 250 is installed at the anti-frost passage 244 of the nozzle block 240. When the nozzle block 240 has a plurality of anti-frost passages 244, a plurality of heaters 250 are installed at the plurality of anti-frost passages 244, respectively.

In addition, the nozzle of the present invention may include a thermocouple sensor 260 or 260*a* to determine whether $CO_2$ is sprayed, similar to the single nozzle of FIG. 1. Preferably, the thermocouple sensor 260 or 260*a* is fixed to an end of the outlet port of the cleaning agent block 210 or an end of the venturi block 240*a* or 240*c* to prevent the sensor from being frozen by $CO_2$, as shown in FIG. 4, and while not shown, may be fixed using a predetermined fastening means such as a pin, a belt, or the like. Therefore, the nozzle of the present invention is capable of determining whether $CO_2$ is sprayed by the temperature detected by the thermocouple sensor 260 or 260*a* installed at the end of the cleaning agent block 210 or the venturi block 240*a* or 240*c*.

Operation of the multi nozzle of the present invention will now be described.

Carrier gas is supplied from the carrier gas supply source 202 to the nozzle block 240 through the carrier gas block 230. The carrier gas is accelerated through the respective venturies 242*a* of the first venturi block 240*a*, a cleaning agent supplied through the orifice 212 of the cleaning agent block 210 is changed to $CO_2$ snow to be mixed with the carrier gas and then discharged to the surface of the object through the intermediate block 240*b* and the second venturi block 240*c*. The $CO_2$ snow is primarily adiabatically expanded at the venturi 242*a* of the first venturi block 240*a*, and the particles of the $CO_2$ snow grow through the passage 242*b* of the intermediate block 240*b* to be entirely mixed with the carrier gas. And then, the $CO_2$ snow is secondarily adiabatically expanded through the venturi 242*c* of the second venturi block 240*c*, thereby maximizing the size of the snow particles.

Simultaneously, the carrier gas supplied into the anti-frost passage 244 of the nozzle block 240 from the carrier gas block 230 is heated to a high temperature of 100-200° C. by the heater 250 to be sprayed onto the surface of the object through the nozzle block 240.

Modified Embodiment 2

Multi-Nozzle 2

Figure 5:
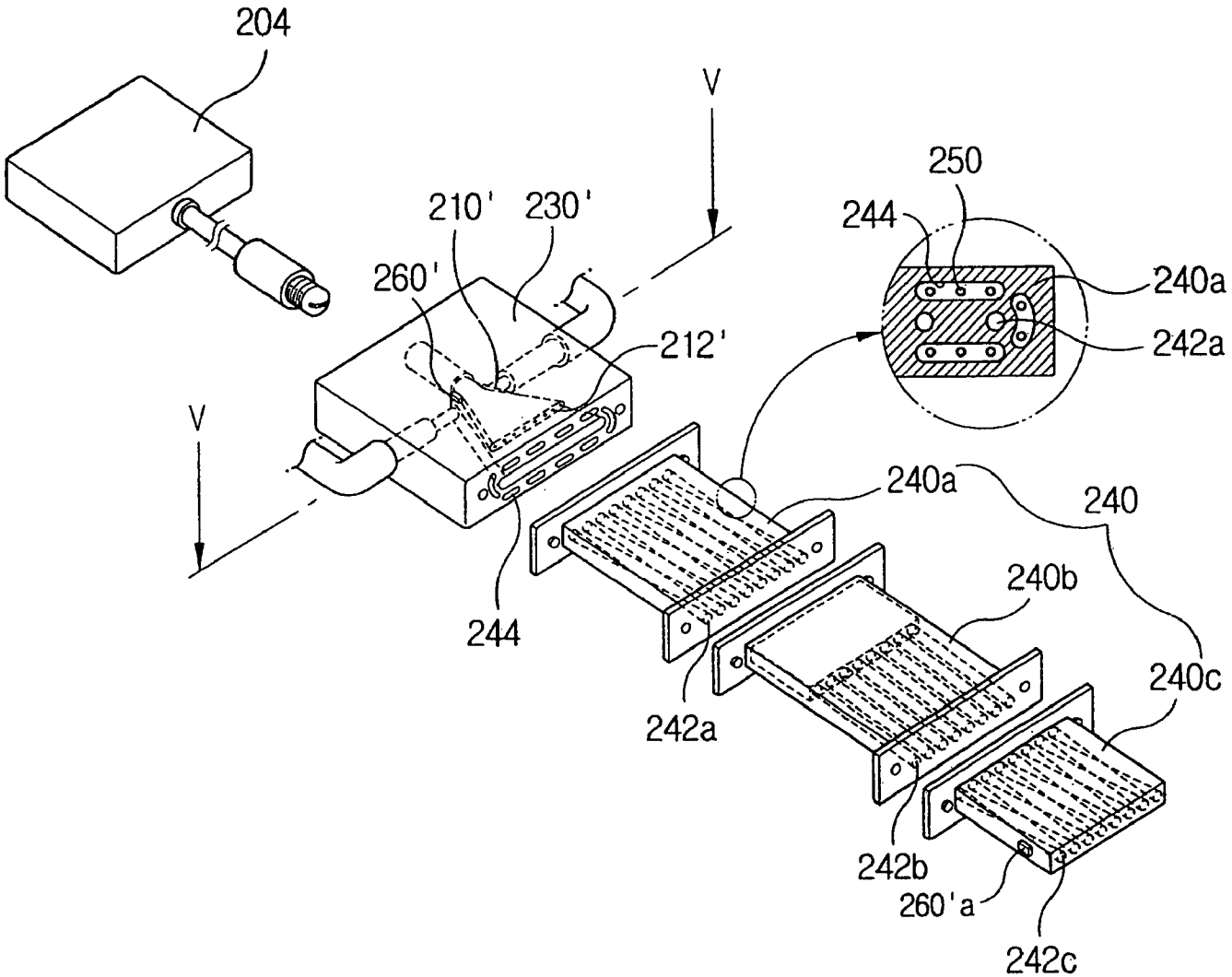
FIG. 5 is a perspective view illustrating a modified example of the multi nozzle.
Figure 6:
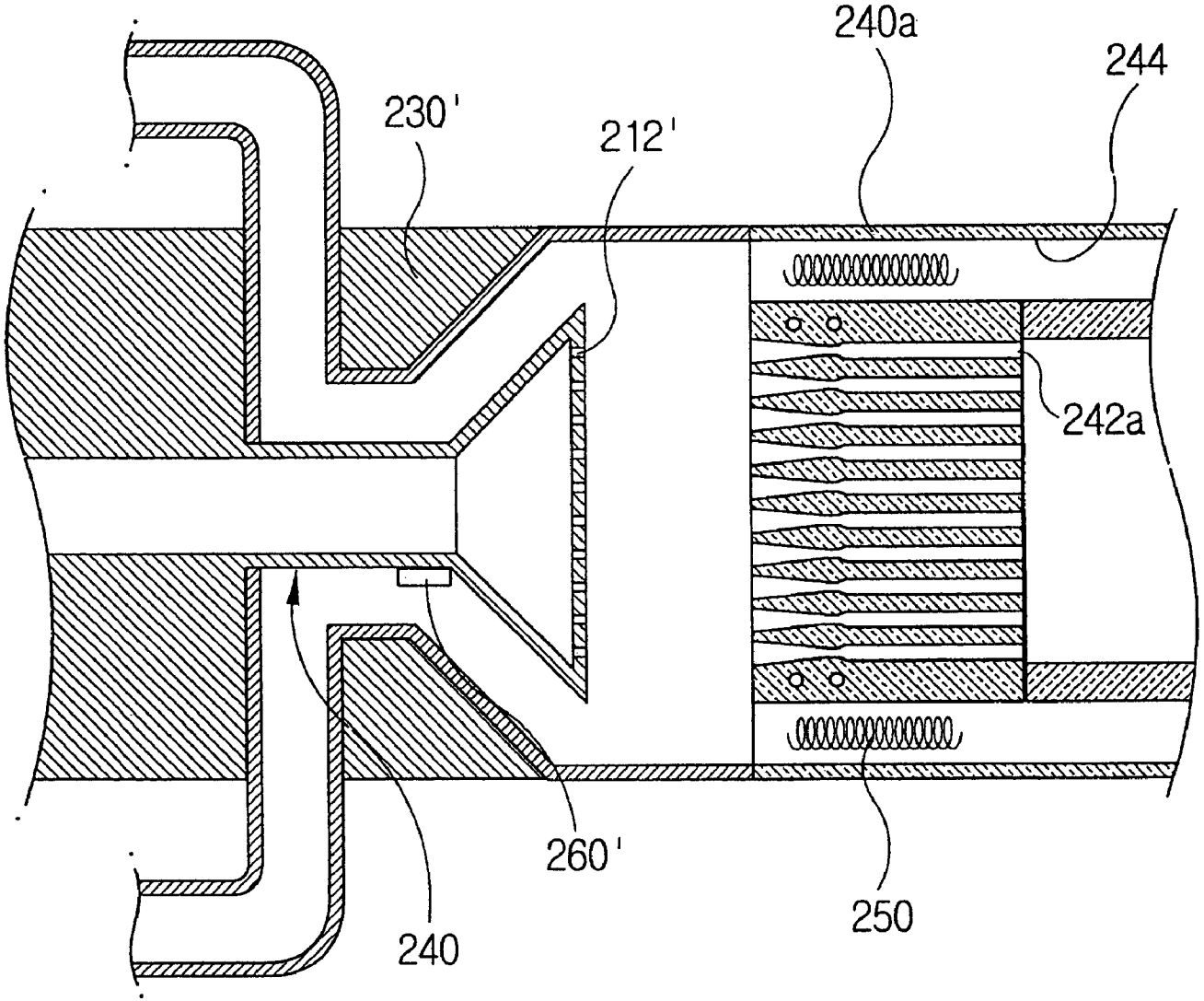
FIG. 6 is a cross-sectional view taken along line V-V of FIG. 5.

FIG. 5 illustrates a modified example of the multi nozzle embodiment of FIGS. 3 and 4, and FIG. 6 is a cross-sectional view taken along line V-V of FIG. 5.

That is, the embodiment of FIGS. 5 and 6 is realized by moving a cleaning agent block 210' to the inlet port of the first venturi block 240*a* from an upper part of the first venturi block 240*a* and installing a carrier gas block 230' to surround a periphery of the cleaning agent block 210', unlike the multi nozzle of FIGS. 3 and 4. The cleaning agent block 210' and the carrier gas block 230' of the embodiment of FIGS. 5 and 6 are engaged with each other, similar to the single nozzle.

The cleaning agent block 210' has an outlet port located at an outlet side of the carrier gas block 230' and includes a plurality of orifices 212' parallelly spaced apart from each other. As a result, the cleaning agent ejected to an outlet space of the carrier gas block 230' from the orifice 212' of the cleaning agent block 210' is changed into a snow state through adiabatic expansion due to pressure drop.

The carrier gas block 230' has a pair of inlet ports formed at both sides thereof to supply carrier gas from a carrier gas supply source (not shown) to the both sides of the carrier gas block 230'. In addition, the carrier gas block 230' has an outlet port for surrounding the outlet port of the cleaning agent block 210' to be in fluid communication with the anti-frost passage 244 and the venturies 242*a* of the first venturi block

240*a* of the nozzle block 240. The anti-frost passage 244 is in fluid communication with the outlet space of the carrier gas block 230' at an upstream side rather than the outlet port of the cleaning agent block 210', similar to the single nozzle. Therefore, the cleaning agent is not introduced into the anti-frost passage 244, and only the carrier gas is supplied into the anti-frost passage 244.

Meanwhile, the nozzle block 240 including the first venturi block 240*a*, the intermediate block 240*b*, the second venturi block 240*c*, and the anti-frost passage 244, and the heater 250 have the same structure as the embodiment of FIGS. 3 and 4. Therefore, its description will be substituted by that of the embodiment of FIGS. 3 and 4

The nozzle of the present embodiment may include a thermocouple sensor 260' or 260*a*' for determining whether $CO_2$ is sprayed, as shown in FIGS. 1 and 3, which is preferably installed at an end of the outlet side of the cleaning agent block 210' or an end of the venturi block 240*a* or 240*c* to prevent the sensor from being frozen by $CO_2$, as shown in FIGS. 5 and 6. Of course, although not shown, the thermocouple sensor 260' or 260*a*' may be fixed using a fastening means such as a pin, a belt, and so on. As described above, the nozzle of the present invention is capable of determining whether $CO_2$ is sprayed by the temperature detected by the thermocouple sensor 260' or 260*a*' installed at the end of the cleaning agent block 210' or the venturi block 240*a* or 240*c*.

Operation of the nozzle of the present invention as shown in the above different embodiments will now be described in conjunction with FIG. 7.

Figure 7:
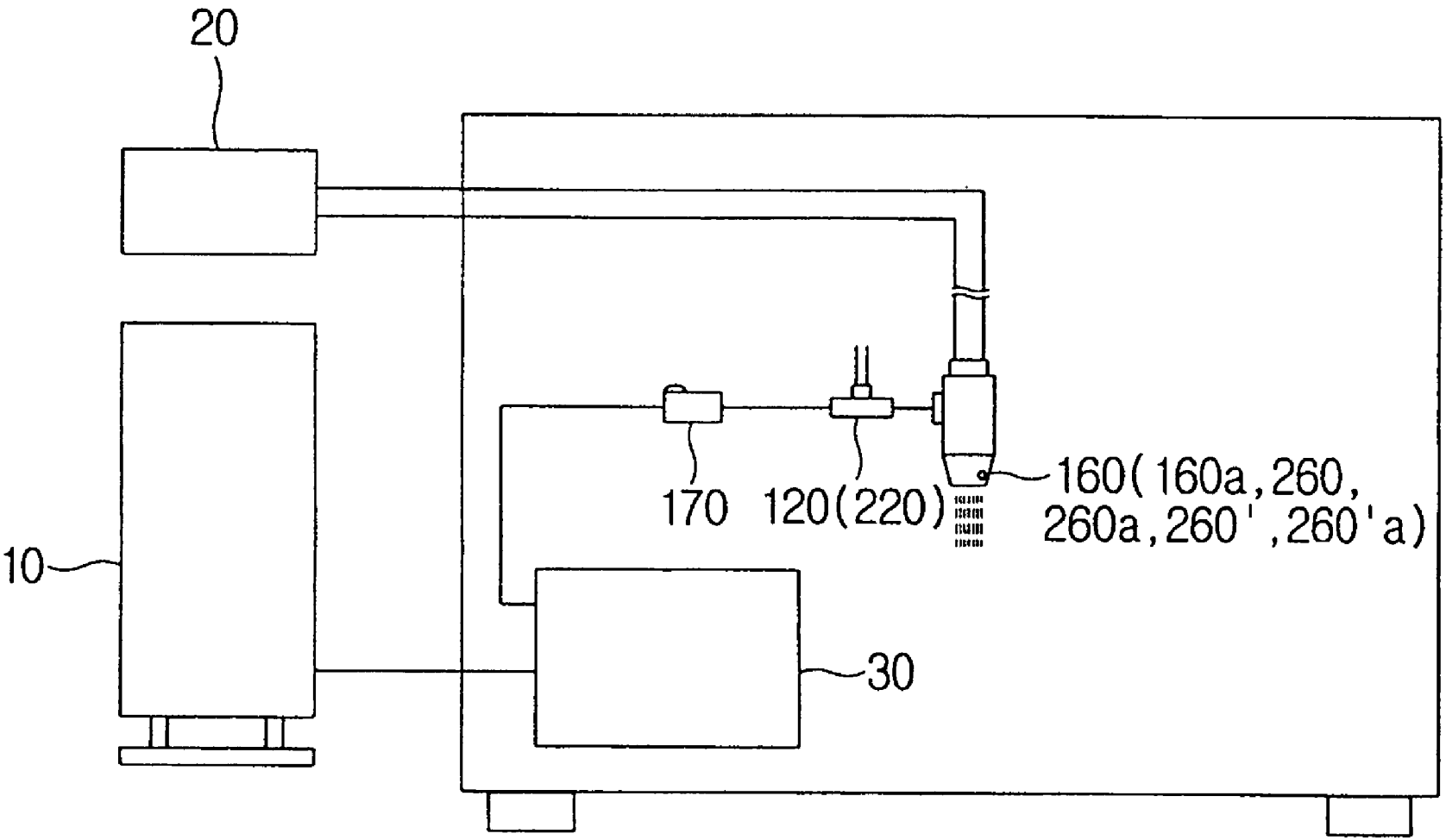
FIG. 7 is a schematic view illustrating an operation state of a spray nozzle according to the present invention.

FIG. 7 is a schematic view illustrating an operation state of the spray nozzle in accordance with the present invention described through the embodiments of FIGS. 1 to 6. When a high-pressure $CO_2$ cleaning agent is supplied from a $CO_2$ reservoir tank 10 to a cooler 30, the cooler 30 filters the $CO_2$ to change its phase to liquid and supplies the liquid $CO_2$ to a spray nozzle. Here, a supply flow rate of the liquid $CO_2$ is regulated by a flow rate regulation valve 120 or 220 installed at an inlet side of the spray nozzle, and a minor amount of dry ice particles are supplied into the interior of the nozzle together with $N_2$ or the air provided from the carrier gas supply source 20, depending on a flow rate regulated by the flow rate regulation valve 120 or 220. In addition, as described in the embodiments of FIGS. 1 to 6, it is possible to determine whether $CO_2$ is sprayed using the thermocouple sensor 160, 160*a*, 260, 260*a*, 260', or 260*a*' installed at the outlet side of the spray nozzle.

Meanwhile, as shown in FIG. 7, the spray nozzle of the present invention may install a solenoid valve 170 between the cooler 30 and the regulation valve 120 or 220 for supplying the liquid $CO_2$. The supply of the liquid $CO_2$ can be controlled through open/close operations of the solenoid valve 170 in response to electrical signals.

According to the present invention as described above, the nozzle for spraying sublimable solid particles entrained in gas for cleaning a surface in accordance with the present invention is capable of preventing frost from forming at the surfaces of the nozzle and the object by spraying a high-temperature carrier gas directly through the nozzle or along the surface of the nozzle.

Therefore, it is possible to perform a cleaning operation in a normal atmosphere since there is no probability of frost. It is possible to remarkably simplify the constitution of the apparatus since there is no need for a chamber for maintaining a dry cleaning environment, or various devices for preventing the generation of static electricity. And it is possible to more widely and freely perform the cleaning operation using the sublimable solid particles.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A nozzle for spraying sublimable solid particles entrained in gas for cleaning a surface, the nozzle comprising:

a cleaning agent block having an inlet port in fluid communication with a cleaning agent supply source, and an outlet port including a plurality of orifices, disposed in parallel, for phase changing a cleaning agent into a snow containing sublimable solid particles;

a nozzle block having a plurality of inlet ports for introducing the cleaning agent snow, including the orifices of the cleaning agent block, a plurality of venturies for growing the cleaning agent snow introduced into the respective inlet ports through adiabatic expansion, and a plurality of outlet ports in fluid communication with the respective venturies for spraying the cleaning agent snow grown through the venturies onto a surface of an object;

a carrier gas block having an inlet port in fluid communication with a carrier gas supply source, and an outlet port in fluid communication with the plurality of inlet ports of the nozzle block for mixing a carrier gas with the cleaning agent snow; and a heater for heating the carrier gas supplied from the carrier gas supply source.

2. The nozzle according to claim 1, wherein each venturi of the nozzle block includes first and second venturies disposed in series.

3. The nozzle according to claim 2, including an intermediate passage having an inner diameter and located between the first and second venturies to facilitate the mixing of the cleaning agent snow and the carrier gas.

4. The nozzle according to claim 1, wherein the carrier gas block is located at the inlet port of the nozzle block, the cleaning agent block is located on the nozzle block, and the inlet port of the nozzle block in fluid communication with the orifice of the cleaning agent block is in fluid communication with a throttle rear end of the venturi.

5. The nozzle according to claim 1, wherein the carrier gas block surrounds the cleaning agent block to engage a front end of the nozzle block.

6. The nozzle according to claim 1, wherein the nozzle block surrounds the venturi, and further comprises an anti-frost passage in fluid communication with the outlet port of the carrier gas block.

7. The nozzle according to claim 1, further comprising a thermocouple sensor for detecting temperature variation when the cleaning agent is sprayed to determine whether the cleaning agent is being supplied.

8. The nozzle according to claim 7, wherein the thermocouple sensor is located at an outlet end of one of the cleaning agent block and the nozzle block.

9. The nozzle according to claim 8, further comprising a solenoid valve for controlling the supply of the cleaning agent through open/close operations in response to electrical signals.

* * * * *